US011225375B1

(12) United States Patent
Mick

(10) Patent No.: US 11,225,375 B1
(45) Date of Patent: Jan. 18, 2022

(54) BATCHER GATE FOR ASPHALT SILO HANDLING

(71) Applicant: CWMF Corporation, Waite Park, MN (US)

(72) Inventor: Travis J. Mick, Saint Cloud, MN (US)

(73) Assignee: CWMF Corporation, Waite Park, MN (US)

( * ) Notice: Subject to any disclaimer, the term of this patent is extended or adjusted under 35 U.S.C. 154(b) by 0 days.

(21) Appl. No.: 17/228,513

(22) Filed: Apr. 12, 2021

Related U.S. Application Data

(63) Continuation of application No. 16/702,455, filed on Dec. 3, 2019, now Pat. No. 10,974,893.

(60) Provisional application No. 62/774,859, filed on Dec. 3, 2018.

(51) Int. Cl.
*B65D 88/58* (2006.01)

(52) U.S. Cl.
CPC ..... *B65D 88/58* (2013.01)

(58) Field of Classification Search
CPC ..... B61D 7/26; B65D 88/26; B65D 88/28; B65D 88/30; B65D 88/32; B65D 88/58; B65D 88/06; B65D 88/08; B65G 67/06
See application file for complete search history.

(56) References Cited

U.S. PATENT DOCUMENTS 3,204,578 A * 9/1965 Floehr ..... B61D 7/20 105/282.2
3,348,501 A * 10/1967 Stevens ..... B61D 7/20 105/248
4,603,787 A * 8/1986 Essary ..... B65D 88/126 220/1.5
5,829,359 A * 11/1998 Dohr ..... B61D 7/26 105/310
6,286,437 B1 * 9/2001 Lucas ..... B61D 7/20 105/282.2
6,363,863 B1 * 4/2002 Dohr ..... B61D 7/20 105/247
6,502,518 B1 * 1/2003 Miller ..... B61D 7/00 105/247
7,051,661 B2 * 5/2006 Herzog ..... B61D 7/02 105/286
7,367,271 B2 * 5/2008 Early ..... B61D 7/20 105/282.2
7,735,426 B2 * 6/2010 Creighton ..... B61D 7/28 105/286

(Continued)

*Primary Examiner* — Donnell A Long
(74) *Attorney, Agent, or Firm* — Albert W. Watkins

(57) ABSTRACT

An asphalt batcher has top and bottom coupling flanges that bolt to a silo, conveyor, and related apparatus. The batcher includes a receptacle for selectively receiving and retaining materials. The receptacle has a material splitter to divide material flowing into the batcher into at least two separate funnels. Adjacent to the outlet, each of the funnels have a receptacle side wall opening. At least one pair of removable batcher gate assemblies are readily inserted into and removed from the receptacle side wall openings. Each batcher gate assembly has a batcher gate door. The pair of batcher gate doors are placed offset from center, closer to the opposed outer walls, and open toward each other and therefore the center to guide materials from the batcher receptacle body out of the batcher and into the silo center. Receptacle side wall access doors provide inspection of and access to the two funnels.

17 Claims, 6 Drawing Sheets

(56) References Cited

U.S. PATENT DOCUMENTS

| | | | | |
|---|---|---|---|---|
| 8,915,194 | B2 * | 12/2014 | Creighton | B61D 7/24 105/286 |
| 2006/0102664 | A1 * | 5/2006 | Brashears | B65D 88/28 222/608 |
| 2009/0158836 | A1 * | 6/2009 | Joyce | G01F 11/028 73/149 |
| 2010/0122546 | A1 * | 5/2010 | Han | F25C 5/20 62/340 |
| 2010/0180982 | A1 * | 7/2010 | Huntington | B65G 67/04 141/94 |
| 2012/0209420 | A1 * | 8/2012 | Christy | B65G 67/06 700/218 |
| 2014/0010620 | A1 * | 1/2014 | Elliott | B65D 90/582 414/288 |
| 2014/0053924 | A1 * | 2/2014 | Lawson | F16K 37/0041 137/554 |
| 2014/0224812 | A1 * | 8/2014 | Herman | B65D 25/42 220/601 |
| 2015/0284194 | A1 * | 10/2015 | Oren | B65D 90/12 414/373 |
| 2018/0028992 | A1 * | 2/2018 | Stegemoeller | B01F 15/0283 |
| 2018/0194372 | A1 * | 7/2018 | Early | B61D 7/26 |
| 2018/0257857 | A1 * | 9/2018 | Fisher | B65D 88/30 |
| 2019/0106273 | A1 * | 4/2019 | Hess | B65G 11/186 |
| 2020/0062280 | A1 * | 2/2020 | Jones | B61D 7/26 |
| 2020/0109005 | A1 * | 4/2020 | Garmendia | B65D 88/30 |
| 2020/0115150 | A1 * | 4/2020 | Froese | B65D 88/08 |
| 2021/0276793 | A1 * | 9/2021 | Ford | B65D 88/12 |

* cited by examiner

BATCHER GATE FOR ASPHALT SILO HANDLING

CROSS REFERENCE TO RELATED APPLICATIONS

The present application claims the benefit of United States provisional patent application 62/774,859 filed Dec. 3, 2018 of like title and inventorship, the teachings and entire contents which are incorporated herein by reference.

BACKGROUND OF THE INVENTION

1. Field of the Invention

The present invention pertains generally to asphalt plants, and more particularly to an improved batcher gate used to introduce material into an asphalt holding silo.

2. Description of the Related Art

In the production of high quality asphalt mix used for the production of roadways and for other purposes, asphalt mixes may be prepared and stored in an asphalt storage silo. The storage silo is typically designed to maintain the asphalt mix at a consistent temperature until discharged.

There are several challenges to production of high quality asphalt. One of these is referred to as segregation, which is quite simply an undesirable separation of materials. For exemplary and non-limiting purposes, aggregate mixtures will commonly include a variety of sizes of aggregate, the sizes and percentages used in the mix carefully selected to provide a most desirable performance for the asphalt. Unfortunately, if the aggregate separates based upon mass per unit particle size, then the mix is greatly harmed. This separation can occur for exemplary purposes when an aggregate mixture is dropped off the end of a rapidly moving conveyor. Heavier and denser materials will tend to drop quickly and more vertically, while lighter materials will be propelled farther sideways. Consequently, asphalt plants are designed to avoid segregation of materials.

One way segregation is avoided is by carefully filling a batcher with material, and then opening the batcher to release the materials into the silo. The batcher may also be used to weigh ingredients. The material may often be loaded into the batcher using a conveyor that lifts the material and then fills the batcher from the top. If the material drops from the center into the batcher, then the material will stay relatively mixed.

Early batchers had a simple single trap door, typically reciprocating or pivoting, that opened and discharged the material. Exemplary U.S. patents that appear to illustrate these concepts, the teachings which are incorporated herein by reference, include: U.S. Pat. No. 1,805,769 by Johnson, entitled "Portable Batcher"; U.S. Pat. No. 1,824,853 by Wells, entitled "Charging device"; U.S. Pat. No. 2,774,515 by Johansson et al, entitled "Transportation containers for bulk materials"; U.S. Pat. No. 2,932,435 by Godwin, entitled "Latch mechanism for bottom-dump bucket"; U.S. Pat. No. 3,834,595 by Brock et al, entitled "Storage bin with flow control sealing apparatus"; U.S. Pat. No. 4,522,321 by Kinoshita, entitled "Gate driving device"; U.S. Pat. No. 4,943,200 by Edwards et al, entitled "Portable self-erecting asphalt storage apparatus and method of erecting same"; and U.S. Pat. No. 5,318,199 by Brashears, entitled "Gate seal for asphalt storage silo". Unfortunately, with these designs the gate opens from one side first, spilling the material in a combined horizontal spread and vertical drop. As already noted, the challenge with the horizontal component of motion is that larger and more dense materials tend to get displaced differently than lighter and less dense components. The end result is a separation of components, including but not limited to aggregate mixes.

To release the material from the batcher and still maintain the mix, two approaches have been taken heretofore. In a first approach, the batcher has a U-shaped gate that pivots from a position at the lowest point of rotation blocking a central opening in the outlet, and in a discharge position rotates out of the way of the central opening. By discharging from the center, the material is maintained generally mixed. In a second alternative approach, the batcher is provided with two gates, with each gate hinged more nearly to an outer wall of the batcher and opening from the center of the batcher. The two gates are hinged on opposite walls of the batcher. This means that horizontal motion conveyed by one of the two gates is approximately equally offset by horizontal motion in an opposed direction generated by the other gate. Since they both open out of the center and are preferably relatively rapidly operated, the material is primarily simply dropped from the batcher, and the material that is deflected is approximately equally and oppositely deflected by the two gates, with a net result of no consequential separation.

Exemplary U.S. patents that appear to illustrate a U-shaped gate, the teachings which are incorporated herein by reference, include: U.S. Pat. No. 2,109,534 by Johnson, entitled "Central mixing plant"; U.S. Pat. No. 3,198,494 by Curran et al, entitled "Mobile Batching Apparatus"; U.S. Pat. No. 3,263,971 by Farnham, entitled "Automatic sampling means for asphalt plants"; U.S. Pat. No. 4,865,458 by Hahn, entitled "Apparatus for blending granules for a roofing product"; U.S. Pat. No. 4,917,560 by Murray et al, entitled "Twin bin self erect silo"; U.S. Pat. No. 5,108,010 by Murray, entitled "Storage Silo with improved material flow"; U.S. Pat. No. 5,251,976 by Milstead, entitled "Asphalt plant adapted for the batch production of asphalt mix containing recycle asphalt paving"; U.S. Pat. No. 5,634,712 by Musil, entitled "Asphalt plant with gas containment system"; U.S. Pat. No. 5,829,871 by Musil, entitled "Asphalt plant with gas containment system and method"; U.S. Pat. No. 7,351,025 by Galijan, entitled "Aggregate handling system"; and U.S. Pat. No. 7,513,280 by Brashears et al, entitled "Apparatus and method for discharging particulate material from storage silos".

Exemplary U.S. patents that appear to illustrate two hinged gates, the teachings which are incorporated herein by reference, include: U.S. Pat. No. 1,733,905 by Randolph, entitled "All steel gravel box"; U.S. Pat. No. 4,248,359 by Brock, entitled "Weigh out system for collapsible surge bin"; and U.S. Pat. No. 4,337,878 by Brock, entitled "Method of weighing and dispensing material from a surge bin".

Both of the U-shaped gate and the dual drop doors are quite effective at preserving the mix and avoiding segregation in a batch. Unfortunately, both are prone to another problem. Over time, the moving parts of the gates will tend to get dirty, clogged, and sticky, making the gates difficult to operate or erratic. When failures occur, the repairs are often so difficult that the plant operators will often simply pry the batcher gates open and allow the materials to pass through the batcher unobstructed. As may be apparent, this defeats the purpose and much needed benefits provided by the batcher.

Additional U.S. patents of varying relevance, the relevant teachings and contents which are incorporated herein by reference, include: U.S. Pat. No. 5,799,825 by Dillman, entitled "Gate seal system"; and U.S. Pat. No. 9,321,589 by Elliott et al, entitled "Discharging particulate materials from storage silos".

As may be apparent, in spite of the enormous advancements and substantial research and development that has been conducted, there still remains a need for a batcher gate that will evenly distribute materials of differing weights and densities, that is more easily be maintained and serviced, enabling an asphalt plant to continue to obtain the necessary benefits provided by the batcher.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, an asphalt batcher, a batcher gate assembly, and an actuator assembly. The asphalt batcher has an inlet; an outlet; and a receptacle body having a receptacle wall and configured to receive asphalt materials from the inlet and to release asphalt materials through the outlet. A batcher gate assembly cut-out is formed in the receptacle wall. The batcher gate assembly has a door; a pivotal shaft affixed with and defining an axis of rotation of the door; and releaseable securements to selectively secure the batcher gate assembly to and release the batcher gate assembly from the asphalt batcher. The batcher gate assembly is selectively partially insertable into the receptacle body and removable therefrom through the batcher gate assembly cut-out. The actuator assembly has an actuator coupled to the asphalt batcher and the batcher gate assembly and is configured to rotate the door and pivotal shaft about the door axis of rotation relative to the asphalt batcher.

In a second manifestation, the invention is, in combination, an asphalt batcher, a batcher gate assembly, a second batcher gate assembly, and an actuator assembly.
The asphalt batcher has an inlet; an outlet; and a receptacle body having a receptacle wall and configured to receive asphalt materials from the inlet and to release asphalt materials through the outlet. A batcher gate assembly cut-out is formed in the receptacle wall. A second batcher gate assembly cut-out is formed in the receptacle wall. The batcher gate assembly has a door; a pivotal shaft affixed with and defining an axis of rotation of the door; and releaseable securements to selectively secure the batcher gate assembly to and release the batcher gate assembly from the asphalt batcher. The batcher gate assembly is selectively partially insertable into the receptacle body and removable therefrom through the batcher gate assembly cut-out. The second batcher gate assembly has a door; a pivotal shaft affixed with and defining an axis of rotation of the door; and releaseable securements to selectively secure the second batcher gate assembly to and release the second batcher gate assembly from the asphalt batcher. The second batcher gate assembly is selectively partially insertable into the receptacle body and removable therefrom through the batcher gate assembly cut-out. The actuator assembly has an actuator coupled to the asphalt batcher and the batcher gate assembly and is configured to rotate the door and pivotal shaft about the door axis of rotation relative to the asphalt batcher. The actuator assembly also has a second actuator coupled to the asphalt batcher and the second batcher gate assembly and is configured to rotate the second batcher gate assembly door and the second batcher gate assembly pivotal shaft about the second batcher gate assembly door axis of rotation relative to the asphalt batcher.

In a third manifestation, the invention is a method of servicing a batcher gate assembly affixed within and controlling discharge from an asphalt batcher receptacle. The method comprises the steps of: emptying at least a portion of the contents of said asphalt batcher receptacle; removing at least one fastener securing a batcher gate cover to said asphalt batcher receptacle; disconnecting said batcher gate cover from said asphalt batcher receptacle; rotating a batcher gate door to a closed position; at least partially removing a batcher gate crank arm from a batcher gate pivotal shaft; releasing at least one gate assembly fastener from a gate assembly fastener hole; and translocating said batcher gate assembly away from said asphalt batcher receptacle.

OBJECTS OF THE INVENTION

Exemplary embodiments of the present invention solve inadequacies of the prior art by providing a combination of at least one pair of receptacle side wall openings and at least one pair of removable batcher gate assemblies that are readily inserted into and removed from the receptacle side wall openings. The batcher gate doors are placed offset from center, closer to the opposed outer walls, and point toward each other and therefore the center to guide materials from the batcher receptacle body out of the batcher and into the center of the silo.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a batcher gate that will evenly distribute materials of differing weights and densities. A second object of the invention is to provide a batcher gate that is relatively easily inspected, maintained, and serviced, without the need to remove the batcher from silo. Another object of the present invention is to enable an asphalt plant operator to intuitively inspect, maintain, and service a batcher, to thereby maintain proper operation and thereby obtain the necessary benefits provided by a batcher.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides a batcher gate that may more easily be maintained and serviced, enabling an asphalt plant to obtain the necessary benefits provided by the batcher with very little down or idle time required for service or repair.

Figure 1:
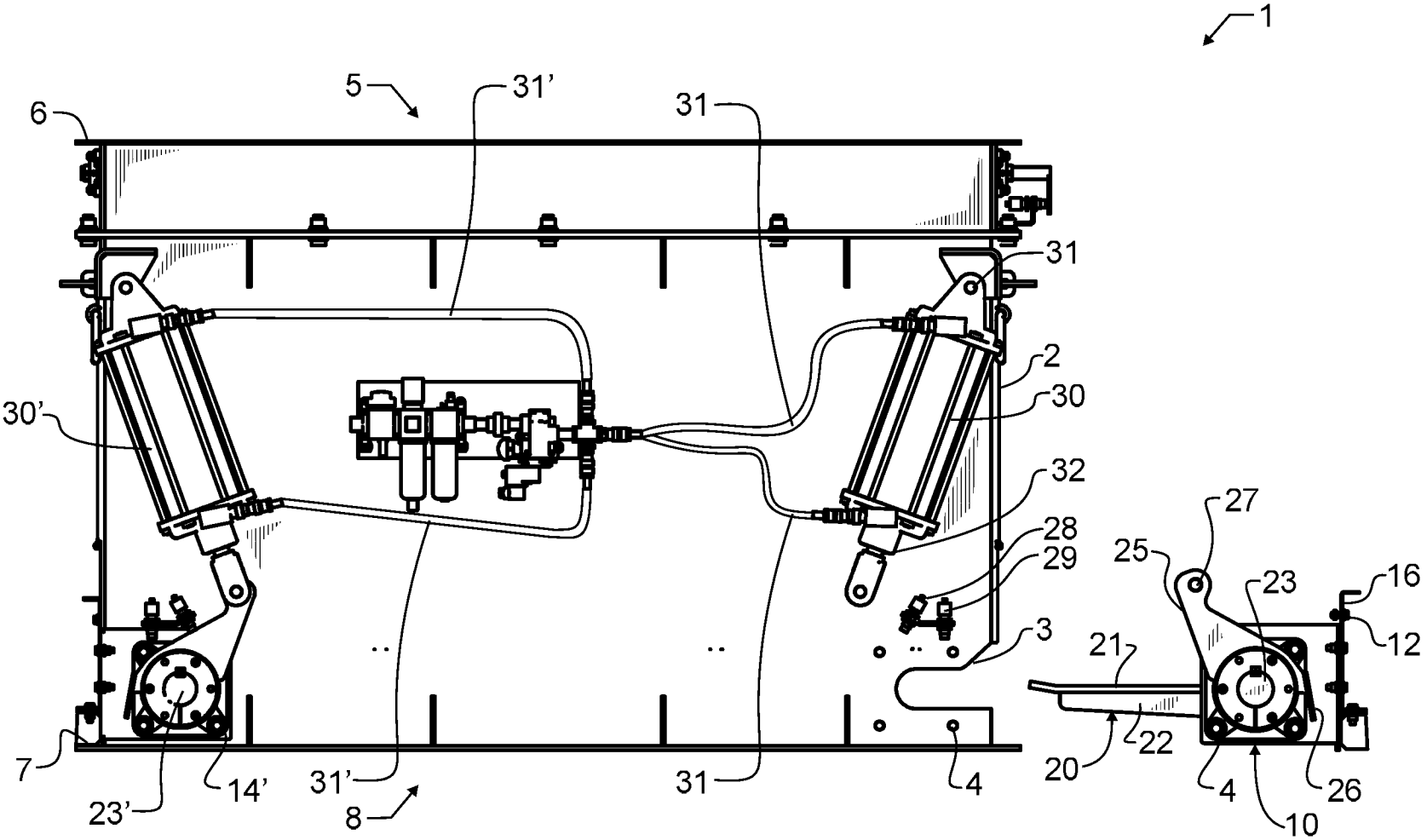
FIG. 1 illustrates a preferred embodiment batcher gate for asphalt silo handling in combination with a preferred embodiment batcher designed in accord with the teachings of the present invention from side elevational view and with one preferred embodiment batcher gate for asphalt silo handling removed from the preferred embodiment batcher.
Figure 2:
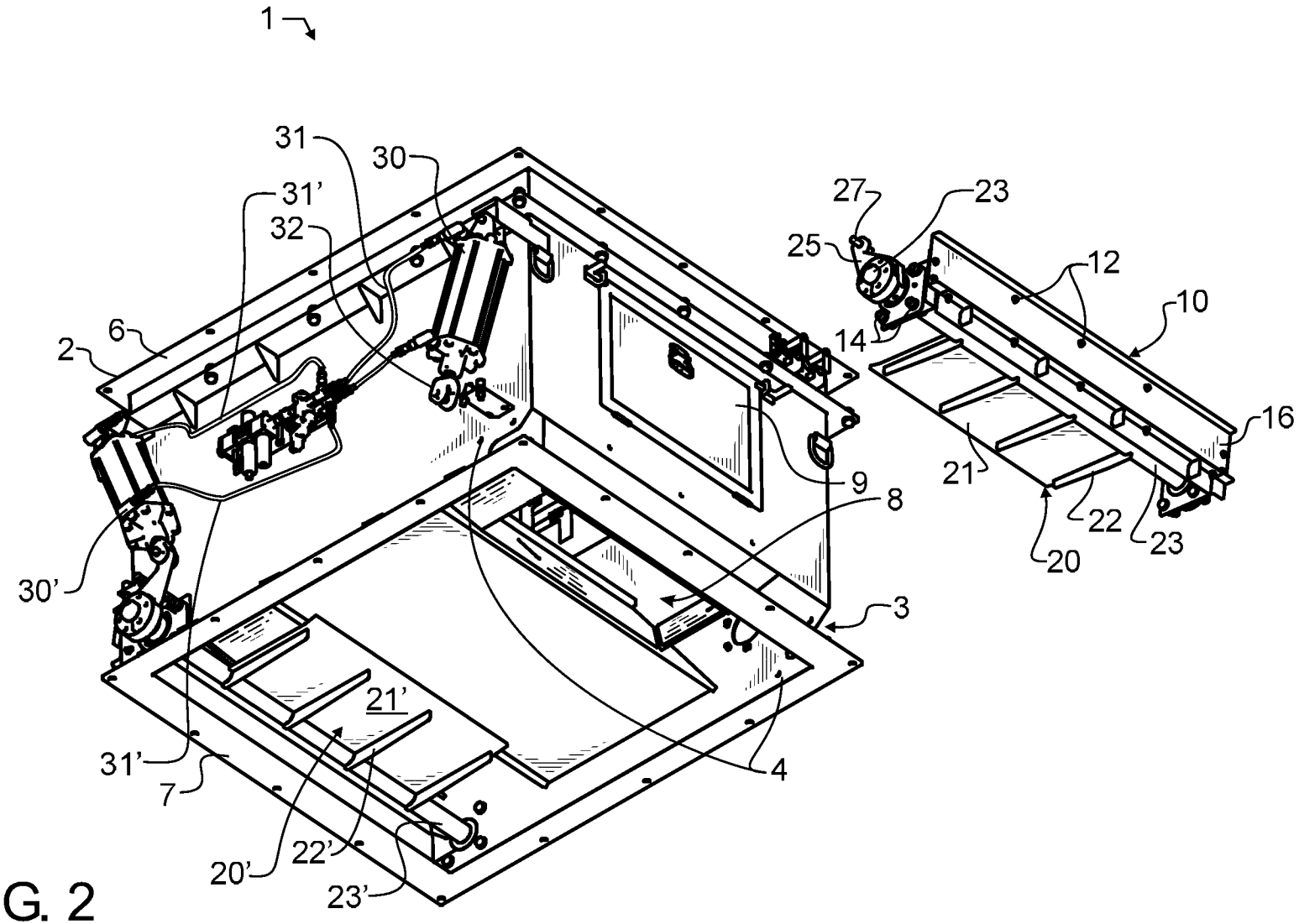
FIG. 2 illustrates the preferred embodiment batcher gate and batcher of FIG. 1 from a lower isometric view, also with one preferred embodiment batcher gate for asphalt silo handling removed from the preferred embodiment batcher.

In a preferred embodiment of the invention illustrated in FIGS. 1-6, an asphalt batcher 1 is comprised of a receptacle body 2 having at least one gate assembly opening 3 visible in FIGS. 1 and 2 formed in a lower side of receptacle body 2. Adjacent to gate assembly opening 3 are a plurality of gate assembly fastener holes 4, also best visible in FIGS. 1 and 2. At the top of preferred embodiment asphalt batcher 1 there is a batcher inlet opening 5 into receptacle body 2, the opening 5 suitable for receiving asphalt components and mixtures. Batcher upper coupling flange 6 provides a flat surface with a plurality of bolt holes which facilitates coupling batcher inlet opening 5 to other common inlet structures. For exemplary and non-limiting purposes, such inlet structures might include various support components, cover plates, additional doorways, funnels, and couplings to conveyors and the like. A batcher lower coupling flange 7 facilitates coupling batcher outlet opening 8 to other common outlet structures. Again for exemplary and non-limiting purposes, such outlet structures might include various support components, funnels, and couplings to conveyors and the like. As is known in the art, a batcher is typically mounted between conveyors and a silo, and is designed to accumulate material therebetween to minimize segregation and to drop material to the center of the silo. Consequently, when so installed, preferred embodiment asphalt batcher 1 will be affixed adjacent to the top of the silo and below one or more conveyors. The provision of batcher upper coupling flange 6 and batcher lower coupling flange 7 allows preferred embodiment asphalt batcher 1 to be readily bolted into proper position at the time of installation.

Secured into gate assembly opening 3 is a batcher gate assembly 10. Batcher gate assembly 10 includes a batcher gate 20 pivotal about gate pivotal shaft 23. A pair of suitable bearings, bushings or the like are preferably provided, along with suitable bearing blocks or mounts. A plurality of gate assembly cover fasteners 12 pass through gate cover 16 and into receptacle body 2. Gate cover 16 thereby works cooperatively with receptacle body 2 and batcher gate assembly 10 to form a full enclosure about the receptacle interior of preferred embodiment asphalt batcher 1. As noted above, along the side walls of receptacle body 2 there may further be provided a plurality of gate assembly fastener holes 4, through which gate assembly fasteners 14 may pass further securing batcher gate assembly 10 into preferred embodiment asphalt batcher 1.

In preferred embodiment asphalt batcher 1, gate pivotal shaft 23 is a keyed shaft, and a matching key is provided on gate crank arm 25, so that rotation of gate crank arm 25 about the longitudinal axis of gate pivotal shaft 23 will rotate gate pivotal shaft 23. Since door 21 and reinforcing ribs 22 are rigidly affixed to gate pivotal shaft 23, rotation of gate pivotal shaft 23 will in turn cause door 21 to rotate between an open position that allows material to discharge from one side of preferred embodiment asphalt batcher 1, and a closed position that blocks one side of batcher outlet opening 8 and thereby retains material within that side of preferred embodiment asphalt batcher 1.

Doors 21 and 21' each extend from generally adjacent a side of receptacle body 2 toward but not all the way to the center of receptacle body 2. As a result, doors 21, 21' when open direct a flow of material from within receptacle body 2 toward and beneath the center of preferred embodiment asphalt batcher 1. Dividing the interior of receptacle body 2 into two discrete sections is a material separator 40. In preferred embodiment asphalt batcher 1, material separator 40 is simply a ridge running down the center of receptacle body 2 equidistant between each of the two batcher gate assemblies 10, 10'. Material falling into batcher inlet opening 5 will be divided into two different funnels 41, 41' that terminate adjacent to the two doors 21, 21'.

While two batcher gate assemblies 10, 10' are illustrated, thereby providing two doors 21, 21', it will be appreciated that more batcher gate assemblies may be provided. However, to obtain the benefit of opposed and offset doors, in more preferred embodiments the number of batcher gate assemblies will be an even number, with the pairs of batcher gate assemblies opposed to each other about the center of receptacle body 2. Material separators and funnels of appropriate geometry will be provided to correspond to the numbers of batcher gate assemblies. For exemplary and non-limiting purpose, if four batcher gate assemblies are provided, material separator 40 will in at least some embodiments take the geometry of a plus sign. Similarly, if six batcher gate assemblies are provided, material separator 40 will in at least some embodiments take the geometry of a star.

In order to open and close doors 21, 21', an actuator assembly is provided to turn pivotal shaft 23. In preferred embodiment asphalt batcher 1, a cylinder bushing 27 is provided with gate crank arm 25 to affix with extendible cylinder rod 32. Cylinder rod 32 is reciprocated linearly by actuation cylinder 30, which may be hydraulic, pneumatic, or otherwise powered.

In preferred embodiment asphalt batcher 1, optional sensors 28, 29 are provided that may be used to confirm the state or degree or extent of rotation of door 21. While not essential to the operation of preferred embodiment asphalt batcher 1, sensors 28, 29 help to preserve the integrity of the mix by detecting doors 21, 21' are open or closed. This detection is separate from and independent of the status of actuation cylinder 30 and extendible cylinder rod 32. Most desirably, if one of doors 21, 21' are open, the doors below such as the silo discharge doors will not be allowed to be opened. Other application for sensors 28, 29 will also be apparent to those skilled in the art, though not important to the present invention. As best visible in FIG. 5, which is illustrated with actuation cylinder 30, gate pivotal shaft 23, and associated collars removed, gate crank arm 25 forms a first extension away form the rotary axis out to cylinder bushing 27 that works cooperatively with sensor 28 to detect when gate crank arm 25 is in a door-closed position. A cam surface 26 is provided distal to gate crank arm 25 and distal to cylinder bushing 27 that works cooperatively with sensor 29 to detect when gate crank arm 25 is in a door-opened position.

As apparent from the partially assembled views of FIGS. 1 and 2, actuation cylinders 30, 30' are used to selectively rotate gate pivotal shafts 23, 23' and thereby open or close batcher gates 20, 20'. Actuation cylinders 30, 30' may for exemplary and non-limiting purpose comprise hydraulic cylinders, though any suitable actuator assemblies may be used, including but not limited to pneumatic, electric, and other known linear actuators. In some alternative embodiments, a rotary actuator assembly is used instead of linear actuation cylinders 30, 30'. In further alternative embodiments, the rotary actuator assembly further comprises a gear assembly. In preferred embodiment asphalt batcher 1, actuation cylinders 30, 30' are coupled via hoses 31 to a hydraulic reservoir, pump, and appropriate valving. In some alternative embodiments where pressurized air is used, actuation cylinders 30, 30' are coupled via hoses 31 to a pressurized air tank, compressor, and appropriate valving.

In the prior art, when servicing is required the contents of receptacle body 2 must be removed. With some door constructions, this can be very difficult. The next step in the prior art is either very difficult servicing of the door assembly or complete removal of the batcher gate from the silo. Because of these challenges, when a batcher door malfunctions many silo operators will leave the batcher gate doors always open, which leads to highly undesirable segregation of materials.

Figure 3:
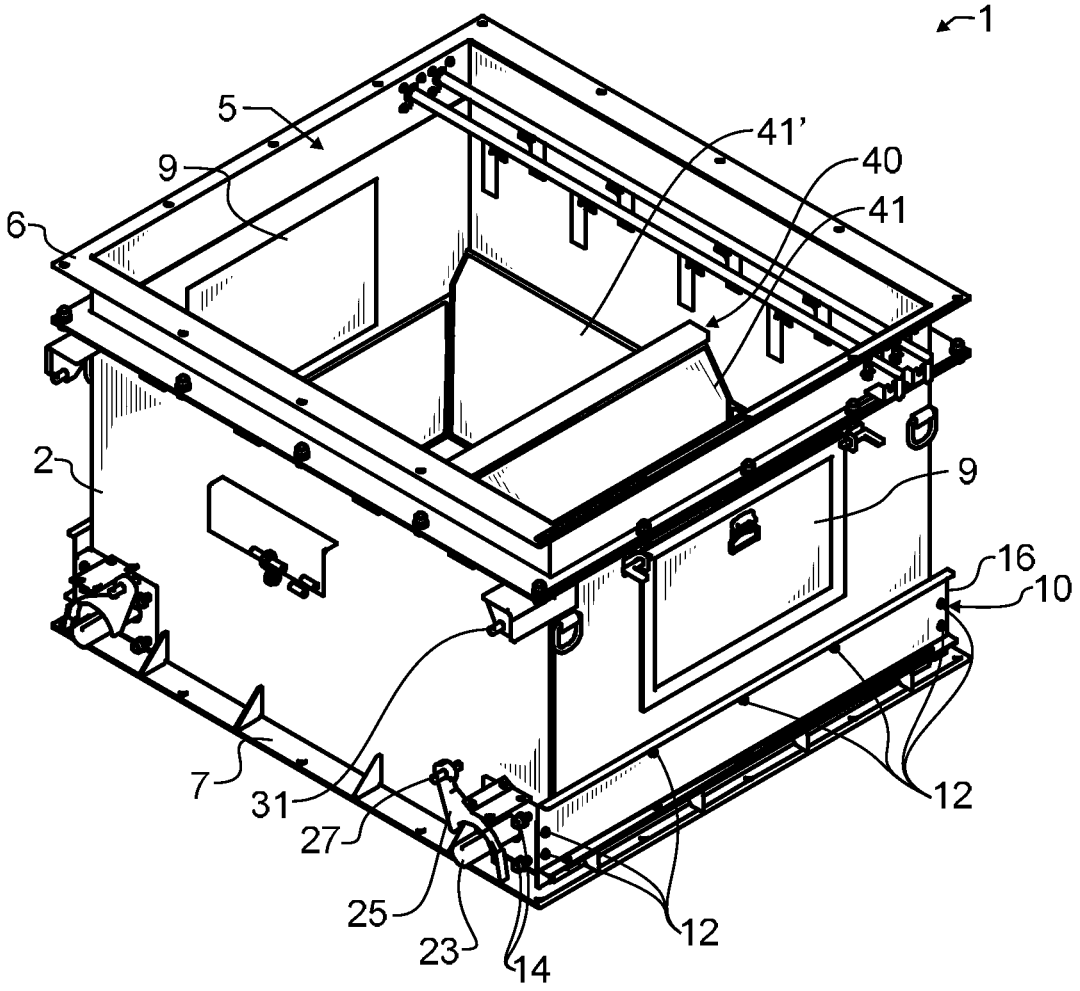
FIG. 3 illustrates the preferred embodiment batcher gate and batcher of FIG. 1 from an upper isometric view, with the actuation cylinders, hoses, and selective parts of the batcher gates removed for purposes of illustration.
Figure 4:
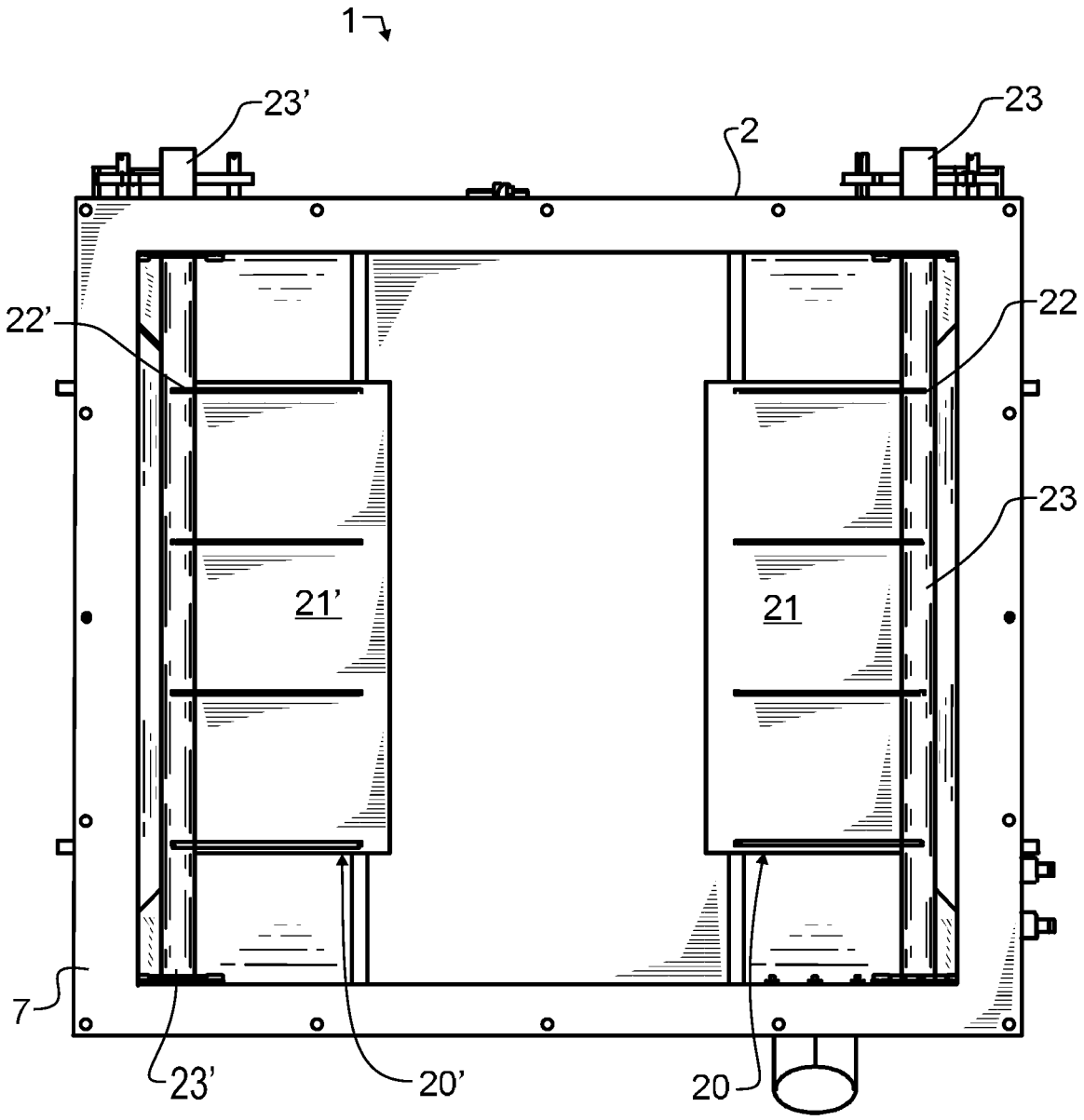
FIG. 4 illustrates the preferred embodiment batcher gate and batcher of FIG. 3 from a bottom plan view.
Figure 5:
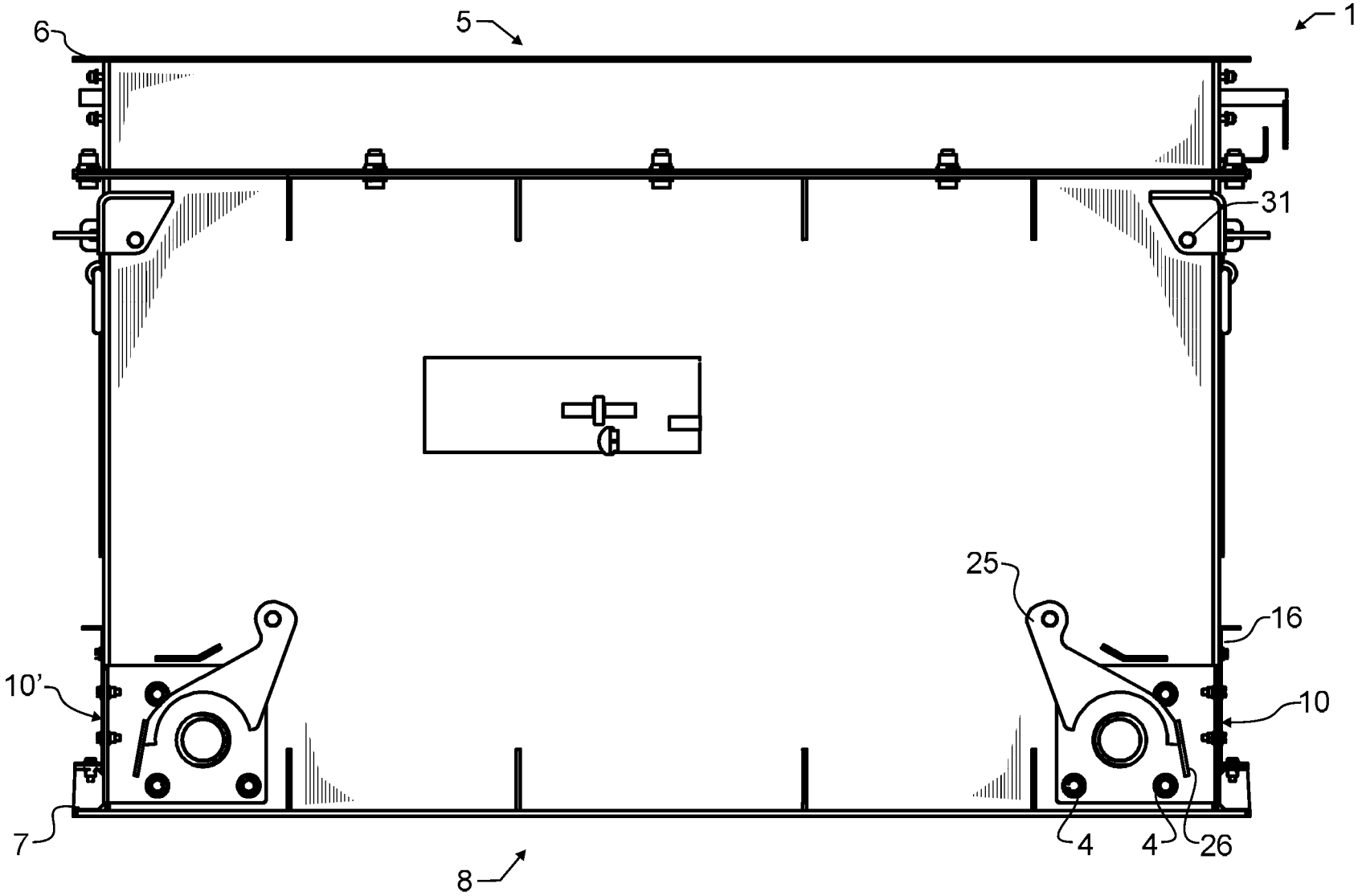
FIG. 5 illustrates the preferred embodiment batcher gate and batcher of FIG. 3 from a side elevational view.
Figure 6:
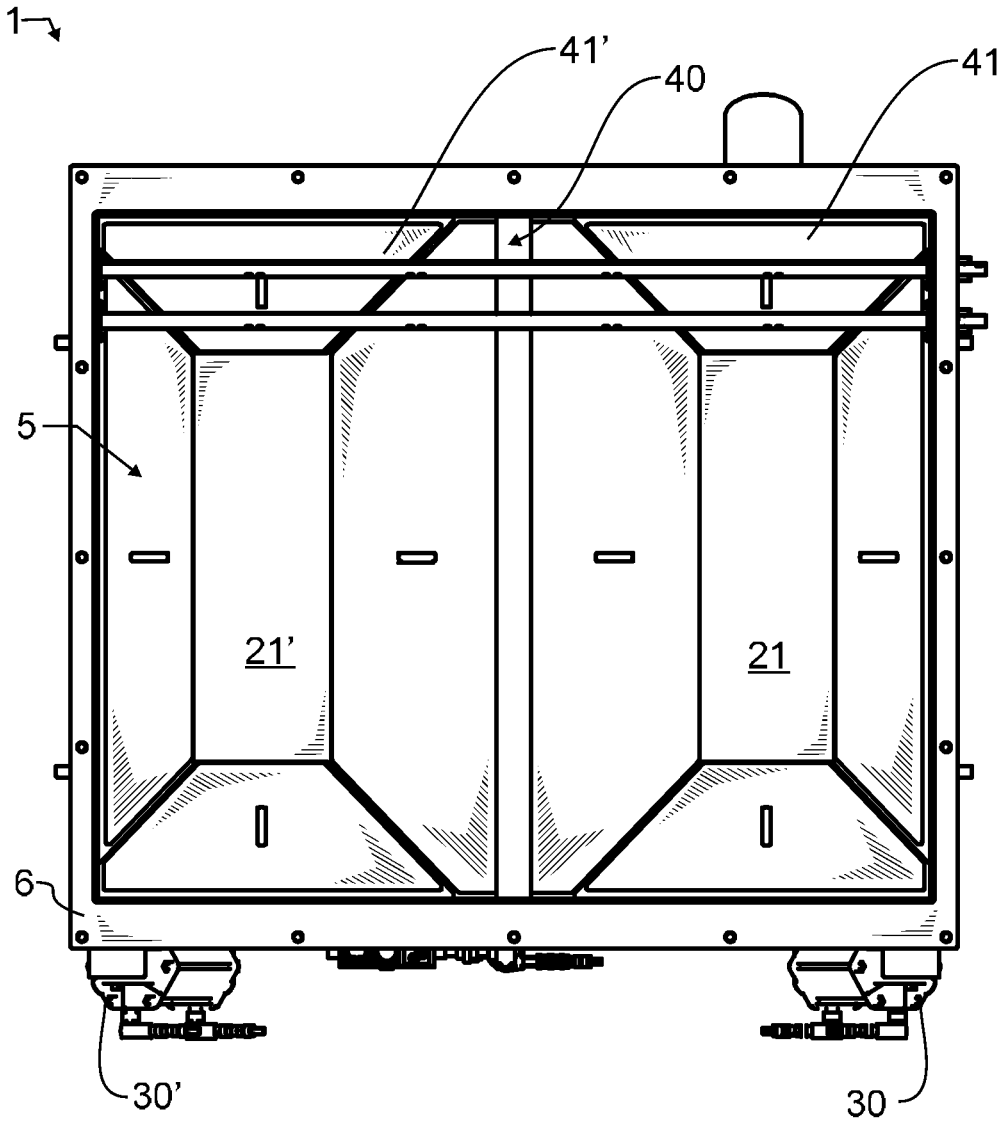
FIG. 6 illustrates the preferred embodiment batcher gate and batcher of FIG. 1 from a top plan view, with the actuation hoses removed for purposes of illustration.

In contrast, and in accord with the teachings of the present invention, batcher gate assembly 10 may be easily removed and inserted. As illustrated in FIGS. 1 and 2, batcher gate 20 is removed, while batcher gate 20' is fully installed. In preferred embodiment asphalt batcher 1, batcher gate assembly 10 is removed by first emptying the contents of one side of receptacle 2. Consequently, if not already open, door 21 is opened by extending extendible cylinder rod 32. If for any reason door 21 cannot be opened without unloading receptacle 2, a receptacle interior access door 9 visible in FIGS. 2 and 3 is preferably provided in the vertical wall of receptacle 2 to allow access from the exterior to the interior or receptacle body 2. Receptacle interior access door 9 is most preferably located just above the start of the sloping outside wall that defines a part of the funnel 41 feeding downward to door 21. Opening receptacle interior access door 9 allows manual removal of the contents within receptacle 2. Receptacle interior access door 9 also provides good access for visual inspection during normal maintenance or at other desirable times.

Next, fasteners 12 are removed from gate cover 16 and receptacle body 2. This allows gate cover 16 to be completely removed. If not closed, door 21 is then rotated to a closed or nearly closed position. Next, gate crank arm 25 must be at least partially removed or pulled from gate pivotal shaft 23, so as to not mechanically interfere with sensors 28, 29. Then gate assembly fasteners 14 in gate assembly fastener holes 4 are removed from both opposed sides of receptacle body 2. This allows a person to translocate batcher gate 20 to the position shown in FIGS. 1 and 2, and from there to perform any required servicing, such as replacement of any bearings or bushings, cleaning, or other required servicing or maintenance.

From the foregoing figures and description, several additional features and options become more apparent. First of all, asphalt batcher 1 and batcher gate assembly 20 may be manufactured from a variety of materials, including metals, ceramics or cementitious materials, or even combinations, laminates, or composites of the above. The specific material used may vary, as is known in the industry. Similarly, the materials to be retained within asphalt batcher 1 are not solely limited to asphaltic compositions, and the present invention may be further applied to other applications and industries, such as in the batching of cement or concrete compositions.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, an asphalt silo, an asphalt batcher, a batcher gate assembly, and an actuator assembly, said asphalt silo having:

a silo inlet;

a silo outlet; and a silo body having a receptacle wall defining a generally vertical axis between said silo inlet and said silo outlet, said silo body configured to receive asphalt materials from said silo inlet and to release said asphalt materials through said silo outlet;

said asphalt batcher secured above and to said asphalt silo, said asphalt batcher having:

a batcher inlet;

a batcher outlet above and adjacent to said silo inlet; and a batcher receptacle body having a receptacle wall rising vertically from said batcher outlet to said batcher inlet and configured to receive asphalt materials from said batcher inlet and to release said asphalt materials through said batcher outlet;

a batcher gate assembly cut-out in said receptacle wall;

said batcher gate assembly having:

a door;

a pivotal shaft affixed with and defining an axis of rotation of said door; and releaseable securements to selectively secure said batcher gate assembly to and release said batcher gate assembly from said asphalt batcher vertically rising receptacle wall;

said batcher gate assembly selectively partially insertable into said receptacle body and removable therefrom through said batcher gate assembly cut-out by movement of said batcher gate assembly in a direction transverse to said silo body vertical axis;

said actuator assembly having:

an actuator coupled to said asphalt batcher and said batcher gate assembly and configured to rotate said door and pivotal shaft about said door axis of rotation relative to said asphalt batcher.

2. The combination asphalt silo, asphalt batcher, batcher gate assembly, and actuator assembly of claim 1, wherein said door extends generally horizontally from said batcher gate assembly when said batcher gate assembly is in a closed position.

3. The combination asphalt silo, asphalt batcher, batcher gate assembly, and actuator assembly of claim 2, wherein said door extends generally vertically from said batcher gate assembly when said batcher gate assembly is in an open position.

4. The combination asphalt silo, asphalt batcher, batcher gate assembly, and actuator assembly of claim 3, wherein said batcher gate assembly further comprises a crank arm affixed to said pivotal shaft and extending radially therefrom.

5. The combination asphalt silo, asphalt batcher, batcher gate assembly, and actuator assembly of claim 4, wherein said actuator assembly further comprises a linear actuator pivotally affixed on a first end to said crank arm and pivotally affixed on a second end distal to said first end to said asphalt batcher.

6. The combination asphalt silo, asphalt batcher, batcher gate assembly, and actuator assembly of claim 5, wherein said actuator assembly further comprises a pair of travel sensors, a first one of said pair of travel sensors affixed to said asphalt batcher and sensing said crank arm when said crank arm is in said batcher gate closed position.

7. The combination asphalt silo, asphalt batcher, batcher gate assembly, and actuator assembly of claim 6, further comprising a cam surface affixed to said crank arm and extending radially from said pivotal shaft angularly displaced from said crank arm, wherein a second one of said pair of travel sensors is affixed to said asphalt batcher and sensing said cam surface when said cam surface is in said batcher gate closed position.

8. The combination asphalt silo, asphalt batcher, batcher gate assembly, and actuator assembly of claim 1, wherein said receptacle body further comprises a funnel adjacent to said outlet.

9. The combination asphalt silo, asphalt batcher, batcher gate assembly, and actuator assembly of claim 1, further comprising:

a second batcher gate assembly cut-out in said receptacle wall;

a second batcher gate assembly having:

a second batcher gate assembly door;

a second batcher gate assembly pivotal shaft affixed with and defining an axis of rotation of said second batcher gate assembly door; and second batcher gate assembly releaseable securements to selectively secure said second batcher gate assembly to and release said second batcher gate assembly from said asphalt batcher;

said second batcher gate assembly selectively partially insertable into said receptacle body and removable therefrom through said second batcher gate assembly cut-out by movement of said second batcher gate assembly in a direction transverse to said silo body vertical axis;

a second actuator assembly having:

a second actuator coupled to said asphalt batcher and said second batcher gate assembly and configured to rotate said second batcher gate assembly door and said second batcher gate assembly pivotal shaft about said second batcher gate assembly door axis of rotation relative to said asphalt batcher.

10. The combination asphalt silo, asphalt batcher, batcher gate assembly, and actuator assembly of claim 9, wherein said receptacle body further comprises a material separator configured to divide said asphalt material received from said inlet between said batcher gate assembly and said second batcher gate assembly.

11. The combination asphalt silo, asphalt batcher, batcher gate assembly, and actuator assembly of claim 1, further comprising a receptacle interior access door providing an inspection and asphalt material removal portal through said receptacle body between an interior of said receptacle body and an exterior of said receptacle body.

12. In combination, an asphalt silo, asphalt batcher, a first batcher gate assembly, a second batcher gate assembly, and an actuator assembly, said asphalt silo having:

a silo inlet;

a silo outlet; and a silo body having a receptacle wall defining a generally vertical axis between said silo inlet and said silo outlet, said silo body configured to receive asphalt materials from said silo inlet and to release said asphalt materials through said silo outlet;

said asphalt batcher secured above and to said asphalt silo, said asphalt batcher having:

a batcher inlet;

a batcher outlet above and adjacent to said silo inlet; and a batcher receptacle body having a receptacle wall rising vertically from said batcher outlet to said batcher inlet and configured to receive asphalt materials from said inlet and to release said asphalt materials through said batcher outlet;

a first batcher gate assembly cut-out in said receptacle wall;

a second batcher gate assembly cut-out in said receptacle wall;

said first batcher gate assembly having:

a door;

a pivotal shaft affixed with and defining an axis of rotation of said door; and releaseable securements to selectively secure said first batcher gate assembly to and release said first batcher gate assembly from said asphalt batcher vertically rising receptacle wall;

said first batcher gate assembly selectively partially insertable into said receptacle body and removable therefrom through said batcher gate assembly cut-out by movement of said first batcher gate assembly in a direction transverse to said silo body vertical axis;

said second batcher gate assembly having:

a second batcher gate assembly door;

a second batcher gate assembly pivotal shaft affixed with and defining an axis of rotation of said second batcher gate assembly door; and second batcher gate assembly releaseable securements to selectively secure said second batcher gate assembly to and release said second batcher gate assembly from said asphalt batcher vertically rising receptacle wall;

said second batcher gate assembly selectively partially insertable into said receptacle body and removable therefrom through said second batcher gate assembly cut-out by movement of said second batcher gate assembly in a direction transverse to said silo body vertical axis;

said actuator assembly having:

a first actuator coupled to said asphalt batcher and said batcher gate assembly and configured to rotate said door and pivotal shaft about said door axis of rotation relative to said asphalt batcher; and a second actuator coupled to said asphalt batcher and said second batcher gate assembly and configured to rotate said second batcher gate assembly door and said second batcher gate assembly pivotal shaft about said second batcher gate assembly door axis of rotation relative to said asphalt batcher.

13. The combination asphalt silo, asphalt batcher, first batcher gate assembly, second batcher gate assembly, and actuator assembly of claim 12, wherein said door extends generally horizontally from said first batcher gate assembly when said first batcher gate assembly is in a closed position, and extends generally vertically from said first batcher gate assembly when said first batcher gate assembly is in an open position.

14. The combination asphalt silo, asphalt batcher, first batcher gate assembly, second batcher gate assembly, and actuator assembly of claim 13, wherein said first batcher gate assembly further comprises a crank arm affixed to said pivotal shaft and extending radially therefrom.

15. The combination asphalt silo, asphalt batcher, first batcher gate assembly, second batcher gate assembly, and actuator assembly of claim 14, wherein said actuator assembly further comprises a linear actuator pivotally affixed on a first end to said crank arm and pivotally affixed on a second end distal to said first end to said asphalt batcher.

16. The combination asphalt silo, asphalt batcher, first batcher gate assembly, second batcher gate assembly, and actuator assembly of claim 12, wherein said receptacle body further comprises a funnel adjacent to said outlet.

17. The combination asphalt silo, asphalt batcher, first batcher gate assembly, second batcher gate assembly, and actuator assembly of claim 12, wherein said batcher receptacle body further comprises a material separator configured to divide said asphalt material received from said inlet between said first batcher gate assembly and said second batcher gate assembly.

* * * * *